United States Patent [19]

Currie

[11] 4,409,900

[45] Oct. 18, 1983

[54] FLYBY WARHEAD TRIGGERING

[75] Inventor: Richard W. Currie, Huntsville, Ala.

[73] Assignee: The United States of America as represented by the Secretary of the Army, Washington, D.C.

[21] Appl. No.: 325,892

[22] Filed: Nov. 30, 1981

[51] Int. Cl.[3] ..... F42C 13/02

[52] U.S. Cl. ..... 102/213

[58] Field of Search ..... 102/213, 214

[56] References Cited

U.S. PATENT DOCUMENTS

| | | | |
|---|---|---|---|
| 2,137,598 | 11/1938 | Vos | 102/213 |
| 2,297,534 | 9/1942 | Brulin | 250/1 |
| 2,350,820 | 6/1944 | Rettinger | 250/1 |
| 2,379,496 | 7/1945 | Saunier, Jr. | 88/1 |
| 3,180,205 | 4/1965 | Heppe et al. | 88/1 |
| 3,946,674 | 3/1976 | Pettersson et al. | 102/213 |
| 4,160,415 | 7/1979 | Cole | 102/214 |
| 4,242,962 | 1/1981 | Wakeman et al. | 102/213 |

FOREIGN PATENT DOCUMENTS

| | | | |
|---|---|---|---|
| 2063430 | 6/1981 | United Kingdom | 102/214 |
| 1598064 | 9/1981 | United Kingdom | 102/213 |

*Primary Examiner*—Charles T. Jordan

*Attorney, Agent, or Firm*—Robert P. Gibson; Anthony T. Lane; Freddie M. Bush

[57] ABSTRACT

A triggering system that provides for fusing a self-forging warhead or other warhead to fire down on a target as the vehicle carrying the warhead flys horizontal by just over the top of the target. The triggering method uses an active optical system (transmitter-receiver) on board the vehicle which establishes a triggering window in space just below the vehicle. A triggering or detonating signal is developed when a target enters the window.

6 Claims, 3 Drawing Figures

FLYBY WARHEAD TRIGGERING

DEDICATORY CLAUSE

The invention described herein may be manufactured, used, and licensed by or for the Government for governmental purposes without the payment to me of any royalties thereon.

SUMMARY OF THE INVENTION

Flyby warhead triggering allows a vehicle such as a missile or projectile to fly by a target intentionally instead of impacting the target. An active optical, transmitter-receiving system on the missile is aimed such that a beam of energy directed from the transmitter intersects the receiver look axis in a predetermined region beneath the missile. The distance below the missile at which the window is located may be adjusted by changing the transmit axis and look axis so that the window may be positioned either very close to or relatively distant from the missile. When a target such as a tank enters the established window space, energy is reflected to the receiver. The received energy initiates a warhead trigger or detonating signal.

DESCRIPTION OF THE PREFERRED EMBODIMENT

Figure 1:
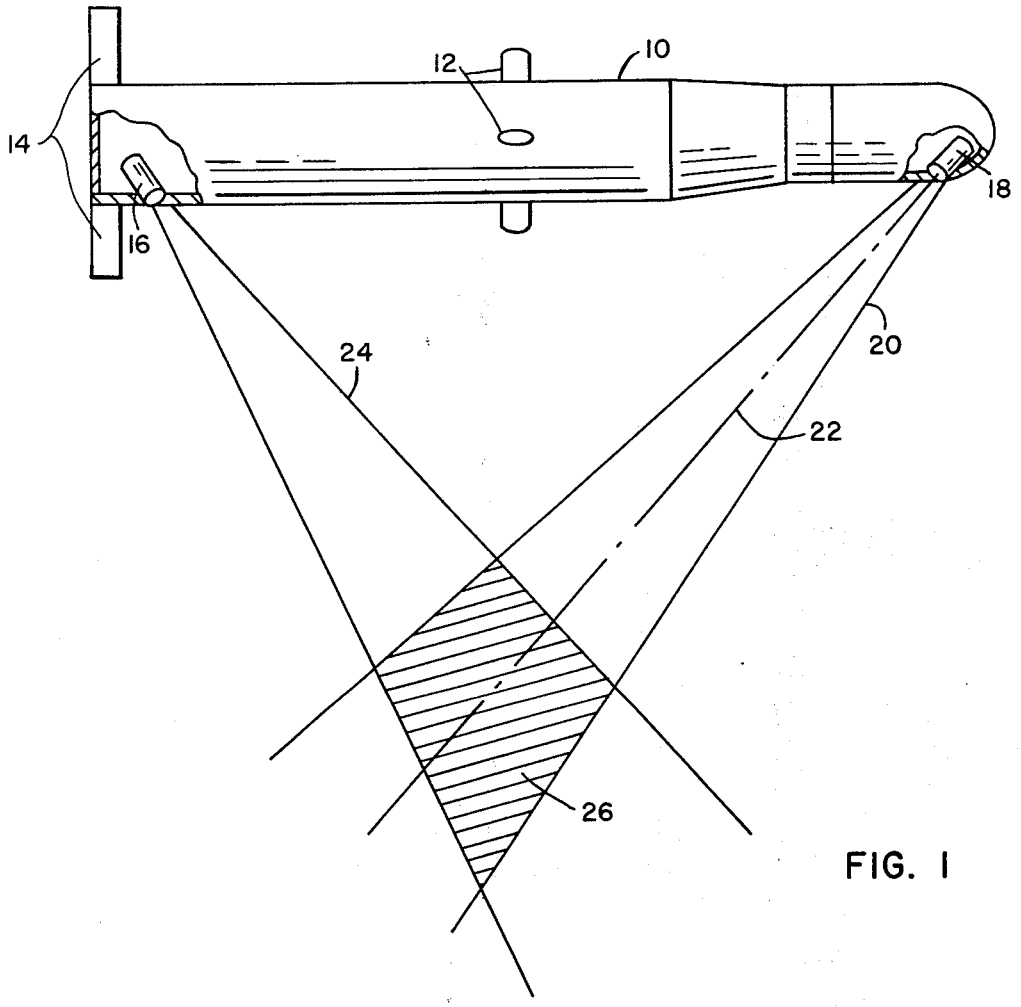
FIG. 1 is a diagram of a preferred embodiment disclosing the flyby triggering method utilized in a missile.

Referring now to the drawings wherein like numbers represent like parts, FIG. 1 is a drawing of a missile 10 incorporating the flyby triggering system. Missile 10 is stabilized by fins 12 and 14. An optical transmitter 16 is located at the rear of missile 10 and directs a well-defined optical beam downward and toward the front of the missile. An optical receiver 18 is mounted at the forward end of the missile in the warhead section for providing a well-defined field of view 20 downward and toward the rear of the missile so that the look axis 22 of the receiver intersects the transmitted optical beam 24. The volume of space where the beam 24 is coincident with the field of view 20 creates a window 26 at a selectable location beneath the missile. Typically, the beam axis for beam 24 and the look axis 22 may intersect and lie in a plane passing through the missile longitudinal axis, with the transmitter and receiver adapted for pivotal or rotational movement to position the intersection point of the beam axis and the look axis at both an adjustable distance from the missile and at an adjustable point toward the front or rear of the missile. For ideal beam reflection from a flat mirror or polished target surface the angle of incidence would substantially equal the angle of reflection of a beam of light so that a relatively limited fore-aft positioning of window 26 would be required to assure a portion of reflected radiation from the target would be intercepted by the receiver. However, for most target surfaces such as military vehicles or weapon emplacements the target surface is relatively rough or nonplanar and the transmitted beam reflected from such targets is more dispersed allowing a greater region for positioning of the window 26, the relationship between the angle of incidence and angle of reflection being insignificant.

Figure 2:
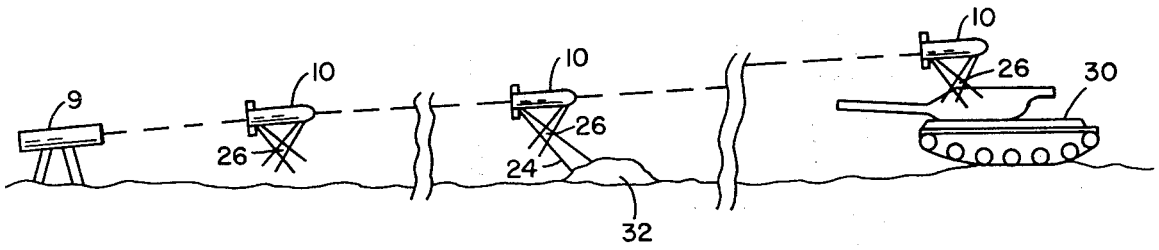
FIG. 2 is a drawing showing the missile flyby path which brings the window across the target surface.

FIG. 2 is a diagram showing progression of a missile flight. Missile 10 is launched from launcher 9 and is in flight toward a target, tank 30. The missile is launched or guided to pass over the tank rather than to hit it. Before reaching tank 30 the missile window 26 is not intercepting a target therefore no return signal goes to the receiver. While the transmitted beam 24 may pass over a projection 32 on the surface, no reflection is received by the receiver since this is outside the established window 26. As the missile passes over the tank 30, the upper uneven surface of the tank comes into the window 26, the transmitted energy 24 is reflected from the tank in the field of view of the receiver and is sensed by the receiver. A trigger signal is then initiated to fire the warhead of the missile.

Figure 3:
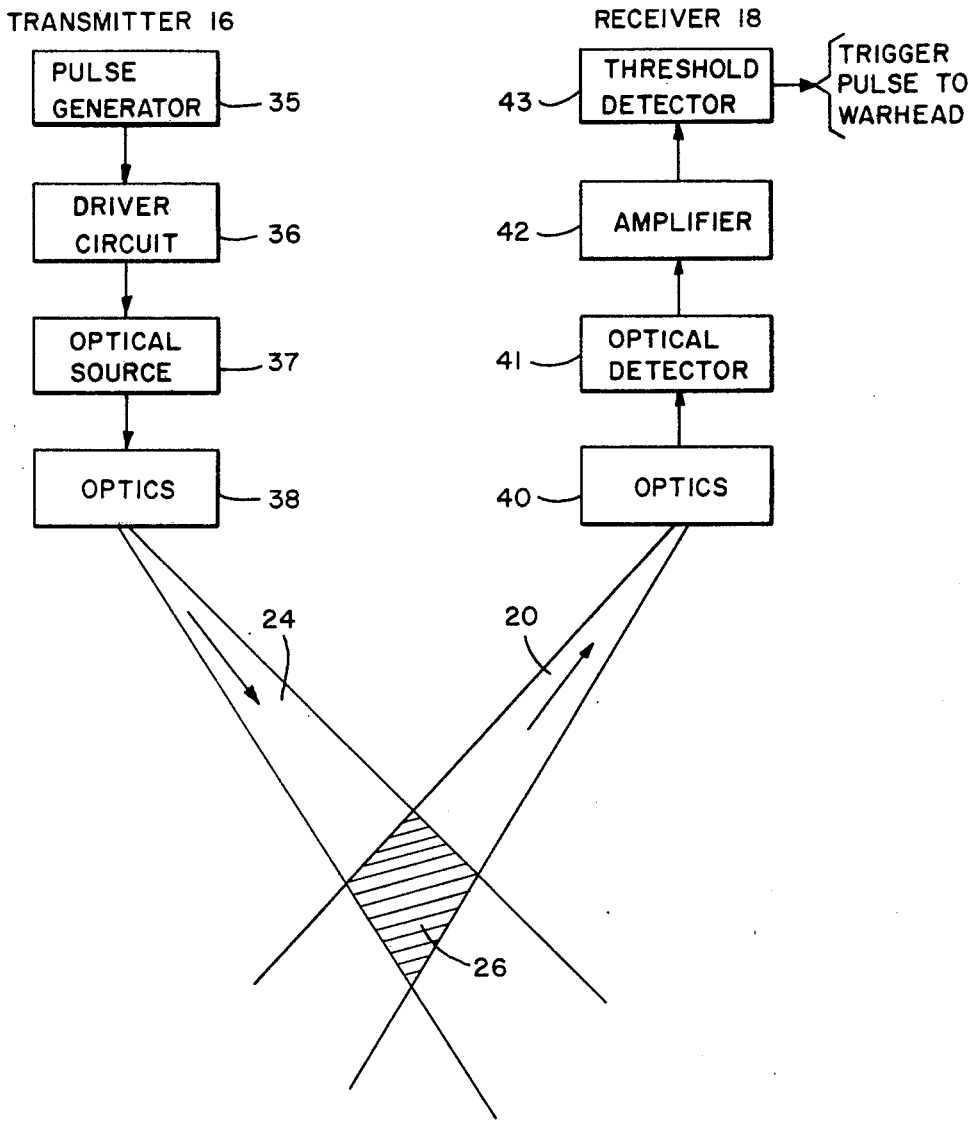
FIG. 3 is a block diagram of a transmitter-receiver circuit for the flyby system.

FIG. 3 is a block diagram of a typical transmitter-receiver circuit for establishing the sensitive window 26. Transmitter 16 is comprised of pulse generator 35, driver circuit 36, an optical source 37, and optics 38 for providing beam 24. Receiver 18 comprises optics 40, optical detector 41, amplifier 42, and threshold detector 43 for receiving reflected energy and providing a trigger pulse output.

In operation, the window is established immediately after launch or system response is otherwise delayed so that a trigger signal is not generated during launch, as is routine procedure. The missile is caused to fly just over the top of the intended target. Typically, missile 10 is launched from a ground or vehicle mounted launcher and flys an elevated flight path to the target. The triggering window is always above ground during flight. When the missile flys over the target, the tank turret enters the window and a reflected return of the transmitter energy is sensed by the receiver, detected by the receiver electronics, and a trigger pulse is initiated to "fire" the warhead. The receiver is optically filtered and electronically tuned to detect reflected transmitter energy from any object that might enter the sensitive window. For objects outside the window 26 no return energy would be sensed.

In the typical circuit of FIG. 3, when the system is activated, electronic pulse generator 35 generates pulses of a known width and frequency. These pulses are amplified by driver circuit 36 which drives GaAs optical source 37. Pulsed optical energy from the GaAs diode source is collected by optics 38 and is radiated outward in a well-defined beam. Reflected energy from the target tank occurs when the upper portion of the tank enters the window in space below the missile. Reflected energy is collected by optics 40 and focused on optical detector 41, which may be a silicon photodiode. Electronic signals from detector 41 are amplified in amplifier 42 and fed to threshold detector 43. The threshold of detector 43 is set well above system noise and generates an output signal when received pulsed energy reflected from the target exceeds this threshold. The output signal from detector 43 is fed to the warhead (not shown) as a detonation signal.

The system will trigger on non-operating vehicles and can be used against non-metal targets such as bunkers or pill boxes. It can attack any target that sticks above the normal ground plane. The system can accommodate a variety of stand-off distance requirements and uncertainties in missile flight paths by adjusting the field-of-view, beam width, power, look-down angles, etc., to form the triggering window's desired size and location below the missile. Therefore, although a particular embodiment of this invention has been illustrated, it is apparent that various modifications of the invention may be made by those skilled in the art without departing from the scope and spirit of the foregoing disclosure. Accordingly, the scope of the invention should be limited only by the claims appended hereto.

I claim:

1. A triggering system comprising; transmitting means for transmitting electromagnetic radiation, receiving means disposed to provide a directional field of view for receiving directional reflected radiation of said electromagnetic radiation and for providing an output trigger signal in response to said received, reflected radiation, a movable vehicle, said transmitting means and said receiving means being mounted on said vehicle, said transmitting means being disposed for directing said electromagnetic radiation external of said vehicle into the field of view of said receiving means for establishing a triggering window in close proximity to the surface of said vehicle where the field of view and the transmitted electromagnetic radiation are coincident.

2. A triggering system as set forth in claim 1 wherein said transmitting means is mounted on the rear portion of said vehicle and said receiving means is mounted on the front portion of said vehicle.

3. A triggering system as set forth in claim 2 wherein said electromagnetic radiation is optical pulses and said vehicle is a missile.

4. In a missile system wherein a missile is launched and directed toward a target, a flyby triggering method for activating or detonating a warhead, and comprising the steps of: directing said missile to fly by the target in close proximity thereto, and establishing an electromagnetic radiation window external of and adjacent to the surface of said missile prior to flyby for initiating a war head trigger signal in said missile in response to reflected radiation detected in said window.

5. In a missile system a flyby triggering method as set forth in claim 4 and further comprising the steps of:

transmitting an optical beam of electromagnetic radiation from the rear of said missile external of said missile and near the surface thereof, pointing an optical receiver mounted in the nose of said missile rearward and external of said missile for directing a field of view of said receiver to intersect said optical beam for thereby establishing said window.

6. In a missile system a flyby triggering method as set forth in claim 5 and further comprising the step of detecting reflected radiation when a target surface is coincident with a portion of the region of said window for initiating said trigger signal.

* * * * *